US011219312B2

(12) United States Patent
Kampl

(10) Patent No.: US 11,219,312 B2
(45) Date of Patent: Jan. 11, 2022

(54) RAIL BAR FOR A DRAWER

(71) Applicant: Julius Blum GmbH, Hoechst (AT)

(72) Inventor: Markus Kampl, Dornbirn (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 16/906,321

(22) Filed: Jun. 19, 2020

(65) Prior Publication Data

US 2020/0315347 A1 Oct. 8, 2020

Related U.S. Application Data

(63) Continuation of application No. PCT/AT2018/060297, filed on Dec. 13, 2018.

(30) Foreign Application Priority Data

Dec. 21, 2017 (AT) ..... A 51062/2017

(51) Int. Cl.
*A47B 88/00* (2017.01)
*A47B 88/938* (2017.01)

(52) U.S. Cl.
CPC ..... *A47B 88/938* (2017.01); *A47B 2088/939* (2017.01)

(58) Field of Classification Search
CPC ..... E05C 17/52; E05C 19/06; E05C 19/063; E05C 19/066; Y10T 292/0814; Y10T 292/0817; Y10T 292/082; Y10T 292/0876; Y10T 292/088; Y10T 292/0894; Y10T 292/0898; Y10T 292/0901; Y10T 292/0907; Y10T 292/42; Y10T 292/438;

(Continued)

(56) References Cited

U.S. PATENT DOCUMENTS 3,137,890 A * 6/1964 Kochanowski ..... A47H 15/00 16/87.2
4,974,987 A * 12/1990 Smock ..... E04B 2/744 403/252

(Continued)

FOREIGN PATENT DOCUMENTS

AT 509847 * 12/2011
CN 101543345 9/2009

(Continued)

OTHER PUBLICATIONS

English translation for WO2013185154 using CN104349698 (Year: 2013).*

(Continued)

*Primary Examiner* — Janet M Wilkens
(74) *Attorney, Agent, or Firm* — Wenderoth, Lind & Ponack, L.L.P.

(57) ABSTRACT

A rail bar for a drawer includes an end to be connected to a wall element, in particular a front panel or a rear wall, of a drawer, and a length adjustment element which is movable relative to the rail bar in the longitudinal direction of the rail bar in order to cover a gap occurring between the end of the rail bar and the wall element in a connected state of the rail bar to the wall element. A spring element is supported on a stationary part of the rail bar and pushes the length adjustment element towards a maximum position, in which the length adjustment element lengthens the rail bar to a maximum extent.

21 Claims, 7 Drawing Sheets

(58) Field of Classification Search

CPC ..... Y10S 292/38; A47B 2096/203; A47B 2220/0086; A47B 88/931; A47B 88/427; A47B 88/95; A47B 88/938; A47B 2088/954; A47B 2088/939; A47B 2088/94; A47B 88/956; A47B 88/941

USPC ..... 312/348.1, 348.2, 330.1, 334.7, 334.8, 312/348.4, 319.1

See application file for complete search history.

(56) References Cited

U.S. PATENT DOCUMENTS

| | | | | |
|---|---|---|---|---|
| 5,076,652 | A | 12/1991 | Lautenschläger | |
| 5,466,061 | A * | 11/1995 | Lautenschlager | A47B 88/931 312/348.2 |
| 6,120,226 | A * | 9/2000 | Egger | A47B 88/90 411/48 |
| 6,402,420 | B1 * | 6/2002 | Yang | F16B 7/0473 403/381 |
| 7,165,790 | B2 * | 1/2007 | Bella | E05C 19/022 292/302 |
| 8,220,885 | B2 * | 7/2012 | Weber | F16B 12/26 312/348.4 |
| 8,424,984 | B2 | 4/2013 | Ritter | |
| 9,060,605 | B2 * | 6/2015 | Gasser | A47B 88/941 |
| 9,161,624 | B2 * | 10/2015 | Haemmerle | A47B 88/931 |
| 9,516,948 | B2 | 12/2016 | Migli | |
| 10,327,550 | B2 * | 6/2019 | Held | A47B 88/941 |
| 10,932,569 | B2 * | 3/2021 | Held | A47B 88/956 |
| 2011/0068670 | A1 | 3/2011 | Ritter | |
| 2011/0163647 | A1 * | 7/2011 | Hartl | A47B 88/931 312/334.7 |
| 2013/0257251 | A1 * | 10/2013 | Gasser | A47B 88/941 312/348.2 |
| 2013/0293079 | A1 * | 11/2013 | Haemmerle | A47B 88/40 312/334.8 |
| 2014/0001938 | A1 | 1/2014 | Migli | |
| 2014/0117828 | A1 * | 5/2014 | Gasser | A47B 88/427 312/333 |
| 2014/0197724 | A1 * | 7/2014 | Gasser | A47B 88/941 312/330.1 |

FOREIGN PATENT DOCUMENTS

| | | | |
|---|---|---|---|
| CN | 102056509 | | 5/2011 |
| CN | 102159117 | | 8/2011 |
| CN | 103459743 | | 12/2013 |
| CN | 104349698 | | 2/2015 |
| DE | 3024972 | * | 1/1982 |
| DE | 89 12 349 | | 1/1990 |
| DE | 4330919 | * | 3/1995 |
| DE | 295 18 690 | | 3/1996 |
| DE | 198 30 740 | | 1/2000 |
| DE | 20 2004 001 8480 U1 | | 12/2004 |
| DE | 202011106766 | * | 10/2011 |
| DE | 102016116178 | * | 3/2018 |
| EP | 698357 | * | 2/1996 |
| EP | 0 702 914 | | 3/1996 |
| EP | 2742826 | * | 6/2014 |
| JP | 5-88347 | | 12/1993 |
| JP | 2012-502697 | | 2/2012 |
| JP | 2015-525577 | | 9/2015 |
| WO | 03/024275 | * | 3/2003 |
| WO | 2009/149479 | | 12/2009 |
| WO | 2012092631 | * | 7/2012 |
| WO | 2013/185154 | | 12/2013 |
| WO | 2019148222 | * | 8/2019 |

OTHER PUBLICATIONS

International Search Report dated Jan. 31, 2019 in International (PCT) Application No. PCT/AT2018/060297.

* cited by examiner

RAIL BAR FOR A DRAWER

BACKGROUND OF THE INVENTION

The invention concerns a rail bar for a drawer, including an end to be connected to a wall element, in particular a front panel or a rear wall, of a drawer, and at least one length adjustment element movable in the longitudinal direction of the rail bar relative to the rail bar in order to cover a gap occurring between the end of the rail bar and the wall element in a connected state of the rail bar to the wall element. The invention further concerns an arrangement comprising at least one such a bar and at least one wall element, in particular a front panel or a rear wall of a drawer, wherein the end of the at least one rail bar is connected to the wall element and a gap occurs between the end of the rail bar and the wall element, the gap being covered by the at least one length adjustment element, and a drawer including at least one such arrangement.

FIGS. 1*a* to 1*c* show a railing bar 101 for a drawer including an end 103 to be connected to a wall element 102, for example a front panel or a rear wall, of a drawer and a length adjustment element 104 movable in the longitudinal direction 105 of the rail bar 101 relative to the rail bar 101 to cover a gap 106 which occurs in a connected state of the rail bar 101 to the wall element 102. Such rail bars are known from the state of the art, for example DE 198 30 740 A1.

In more detail, FIG. 1*a* shows the rail bar 101 with the length adjustment element 104 being shown in two different positions relative to the rail bar 101 or the end 103 of the rail bar 101. In order to change the position of the length adjustment element 104, it is displaced by hand relative to the rail bar 101.

FIGS. 1*b* and 1*c* show an arrangement 114 comprising a rail bar 101 and a wall element 102, wherein the end 103 of the rail bar 101 is connected to the wall element 102 by way of a furniture fitment 112 on the rail bar 101. In order to make the connection between the rail bar 101 and the wall element 102, firstly, the length adjustment element 104 is displaced towards the right, that is to say, away from the wall element 102 of the connecting location. After the connection is made, there is a gap 106 between the end 103 of the rail bar 101 and the wall element 102. In order to cover that gap 106 as well as the visible part of the furniture fitment 112, the user then pushes the length adjustment element 104 towards the left until the length adjustment element 104 bears against the wall element 102 (see position in FIG. 1*c*).

A disadvantage in this case is that the user has to perform a plurality of successive steps for mounting the rail bar 104 to the wall element 102. Therefore, the last step, covering the gap 106, is often forgotten, whereby the appearance of the drawer is adversely affected. Ultimately, that reflects badly on the manufacturer of the rail bar 104.

The same disadvantage can arise by virtue of the fact that, even if the length adjustment element 104 is moved into the position shown in FIG. 1*c* during assembly, at a later time differing from the time of assembly, the length adjustment element 104, is moved out again of that position in the course of the period of use of the drawer, for example due to vibration or when cleaning the drawer.

SUMMARY OF THE INVENTION

The object of the present invention is to avoid the described disadvantages of the state of the art and to provide a rail bar, an arrangement having such a rail bar or, respectively a drawer having such an arrangement which is improved in relation thereto.

In the rail bar according to the invention it is therefore provided that there is at least one spring element which is supported on at least one stationary part of the rail bar and pushes the at least one length adjustment element in the direction of a maximum position in which the at least one length adjustment element prolongs the rail bar to the maximum extent.

The at least one spring element provides that the at least one length adjustment element is automatically pushed in a given direction, namely in the direction of the maximum position in which the at least one length adjustment element prolongs the rail bar to the maximum extent. The maximum position is therefore a preferential position. A user no longer has to actively actuate the at least one length adjustment element in comparison with the state of the art in order to cover a gap which occurs between the end of the rail bar and the wall element in the connected state of the rail bar to the wall element. A malposition of the at least one length adjustment element in which the gap is visible is not possible. In case that the at least one length adjustment element is by mistake moved out of the position in which it covers the gap, for example when cleaning the drawer, that error is automatically corrected by virtue of the at least one length adjustment element being acted upon by the at least one spring element in the direction of the maximum position. Overall, the measures according to the invention enhance the level of operating comfort for the user.

In a preferred embodiment, the at least one length adjustment element projects region-wise beyond the end of the rail bar in positions in which the at least one length adjustment element prolongs the rail bar. This means that the remaining part of the at least one length adjustment element in those positions overlaps with the end of the rail bar, whereby a stable and reliable prolongation of the rail bar can be achieved.

A visually attractive appearance can be achieved by the rail bar having at least one cavity and the at least one length adjustment element being arranged region-wise in the at least one cavity. This way it is possible to show only that portion of the at least one length adjustment element that is necessary for covering the gap between the end of the rail bar and the wall element in the connected state of the rail bar to the wall element.

As mentioned in the opening part of this specification, an arrangement comprises at least one rail bar according to the invention and at least one wall element, in particular a front panel or a rear wall of a drawer. The end of the at least one rail bar is connected to the wall element and a gap occurs between the end of the rail bar and the wall element, said gap being covered by the at least one length adjustment element.

And finally, a drawer includes at least one arrangement according to the invention.

BRIEF DESCRIPTION OF THE DRAWINGS

Further details and advantages of the invention are described more fully hereinafter by means of the specific description with reference to the drawings, in which.

DETAILED DESCRIPTION OF THE INVENTION

Figure 1A:
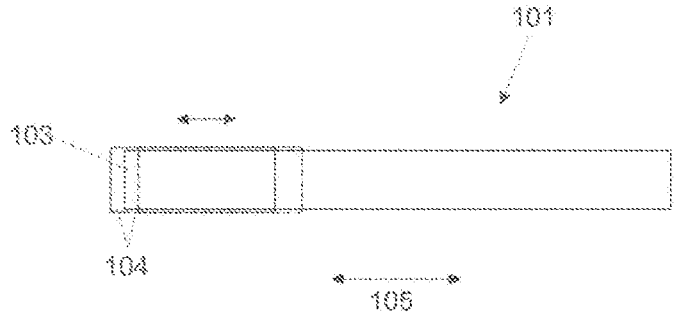
Fig. 1a (PRIOR ART)
FIG. 1*a* is a diagrammatic view from the side of a rail bar according to the state of the art.
Figure 1B:
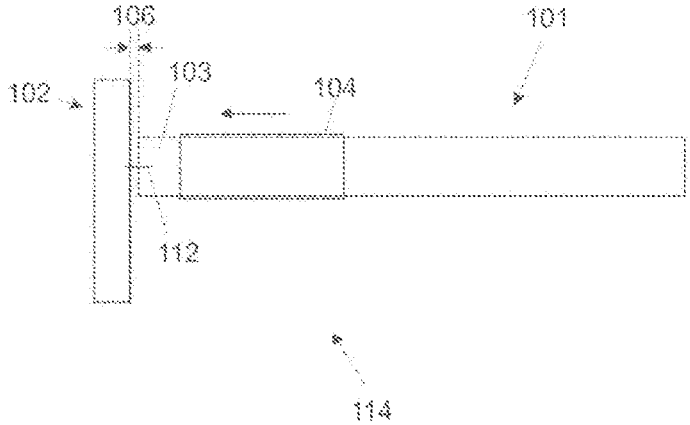
Fig. 1b (PRIOR ART)
FIGS. 1*b* and 1*c* is a diagrammatic view from the side of an arrangement comprising a rail bar and a wall element according to the state of the art with the length adjustment element being shown in two different positions.
Figure 1C:
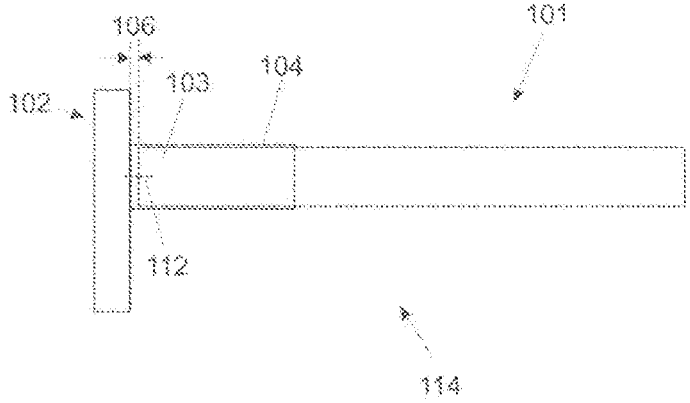
Fig. 1c (PRIOR ART)

FIGS. 1*a* to 1*c* which show the state of the art have already been described in detail in the introduction of this description.

Figure 2A:
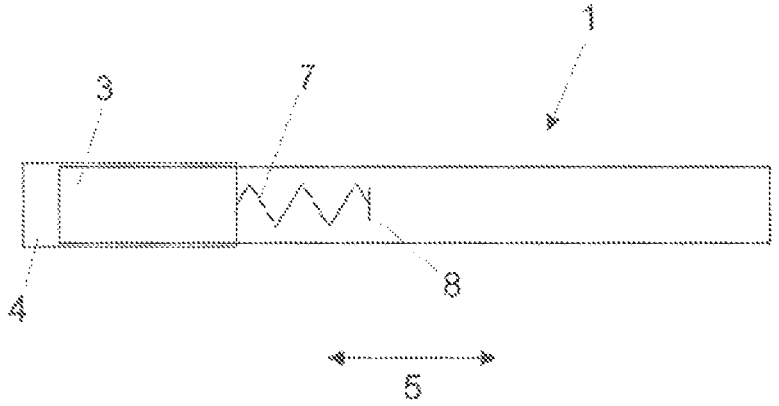
FIG. 2*a* shows a diagrammatic view from the side of a rail bar according to a first preferred embodiment.

FIG. 2*a* shows a first embodiment of a rail bar 1 according to the invention for a drawer, including an end 3 to be connected to a wall element 2, in particular a front panel 17 or a rear wall 18 of a drawer, and a length adjustment element 4 which is movable relative to the rail bar 1 in the longitudinal direction 5 thereof in order to cover a gap 6 which in a connected state of the rail bar 1 to the wall element 2 occurs between the end 3 of the rail bar 1 and the wall element 2. Further, a spring element 7 is provided which is supported at a stationary part 8 of the rail bar 1 and pushes the length adjustment element 4 in the direction of a maximum position in which the length adjustment element 4 prolongs the rail bar 1 to the maximum extent. In order to push the length adjustment element 4 in the direction of the maximum position, the spring element 7 exerts a force on the length adjustment element 4 in that direction.

FIG. 2*a* shows the maximum position of the length adjustment element 4. In this position and in further positions in which the length adjustment element 4 prolongs the rail bar 1, the length adjustment element 4 projects region-wise beyond the end 3 of the rail bar 2. The other region of the length adjustment element 4 that does not project beyond the end 3 of the rail bar 1 overlaps with the rail bar 1.

Starting from that maximum position the length adjustment element 4 is movable in opposition to the force of the spring element 7 as far as a minimum position in which the length adjustment element 4 prolongs the rail bar 1 to a minimum extent or not at all.

Figure 2B:
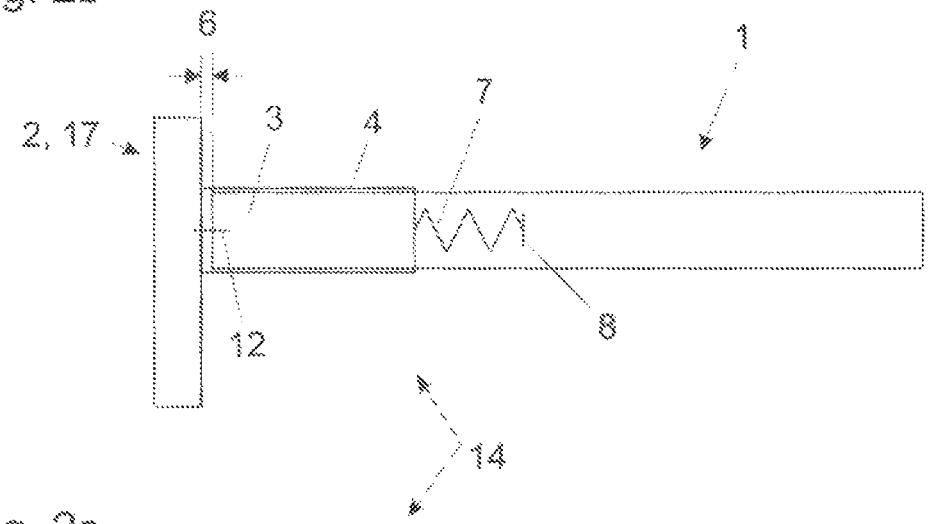
FIG. 2*b* is a diagrammatic view from the side of an arrangement comprising the rail bar of FIG. 2*a* and a wall element according to a first preferred embodiment.

FIG. 2*b* shows a first embodiment of an arrangement 14 according to the invention comprising a rail bar 1 as shown in FIG. 2*a* and a wall element 2 in the form of a front panel 17 of a drawer, wherein the end 3 of the rail bar 1 is connected to the wall element 2 and a gap 6 occurs between the end 3 of the rail bar 1 and the wall element 2 with that gap being covered by the length adjustment element 4.

The arrangement includes a furniture fitment 12 which is separate from the length adjustment element 4 and which, on the one hand, is fixed to the wall element 2 and, on the other hand, to the rail bar 1 at a predetermined position relative thereto.

Figure 2C:
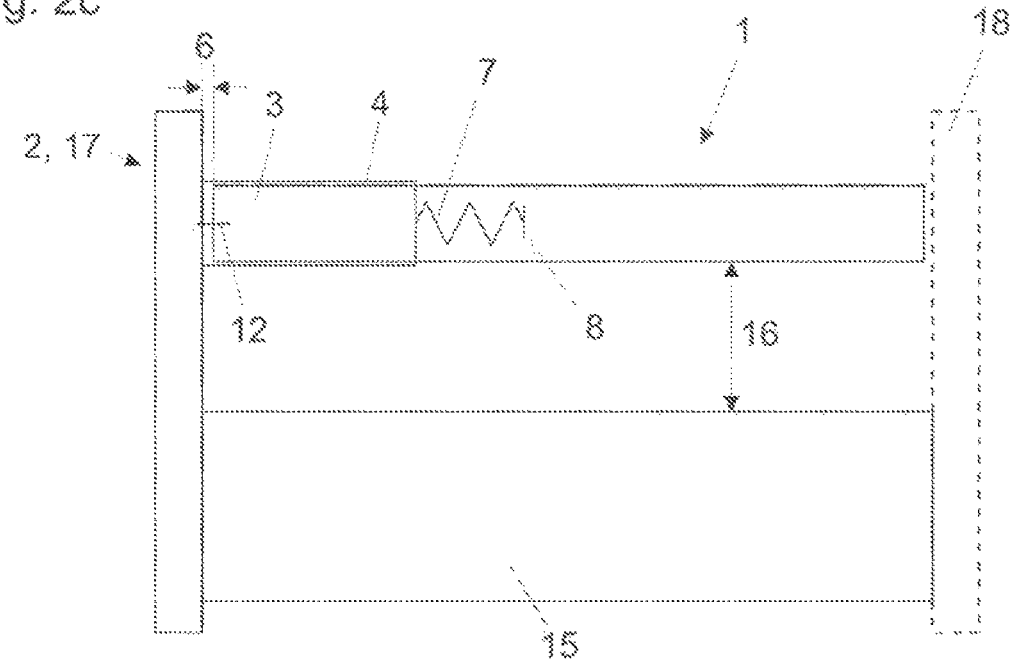
FIG. 2*c* is a diagrammatic view from the side of an arrangement comprising the rail bar of FIG. 2*a* and a wall element according to a second preferred embodiment, FIGS. 3*a* and *b* is a diagrammatic perspective view of a part of a drawer with an arrangement comprising a rail bar and a wall element according to a third preferred embodiment with the arrangement shown in FIG. 3*a* in comparison with the arrangement shown in FIG. 3*b* having a larger gap between the end of the rail bar and the front panel.

FIG. 2*c* shows a second embodiment of an arrangement 14 according to the invention comprising a rail bar 1 as shown in FIG. 2*a* and a wall element 2 in the form of a front panel 17 of a drawer, wherein the end 3 of the rail bar 1 is connected to the wall element 2 and a gap 6 occurs between the end 3 of the rail bar 1 and the wall element 2 with that gap being covered by the length adjustment element 4.

A rear wall 18 of a drawer is also indicated in broken line. When connecting the rail bar 1 to the rear wall 18, at least one length adjustment element 4 according to the invention can also be used in combination with at least one spring element 7 which bears against at least one stationary part 8 of the rail bar 1 in order to cover a gap which in a connected state of the rail bar 1 to the rear wall 18 occurs between the end of the rail bar 1 that is towards the rear wall 18 and the rear wall 18.

The arrangement 14 shown in FIG. 2*c* further includes a drawer side wall 15 with the rail bar 1 being arranged at a spacing 16 above the drawer side wall 15.

Figure 3A:
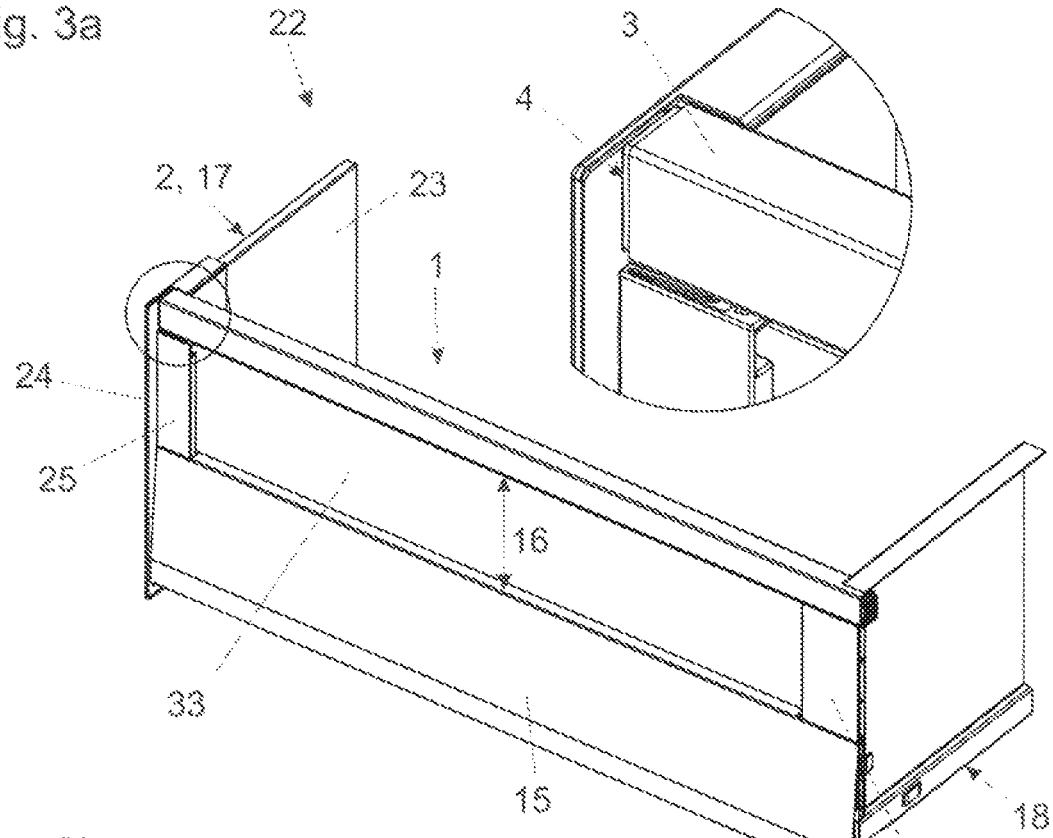
Figure 3B:
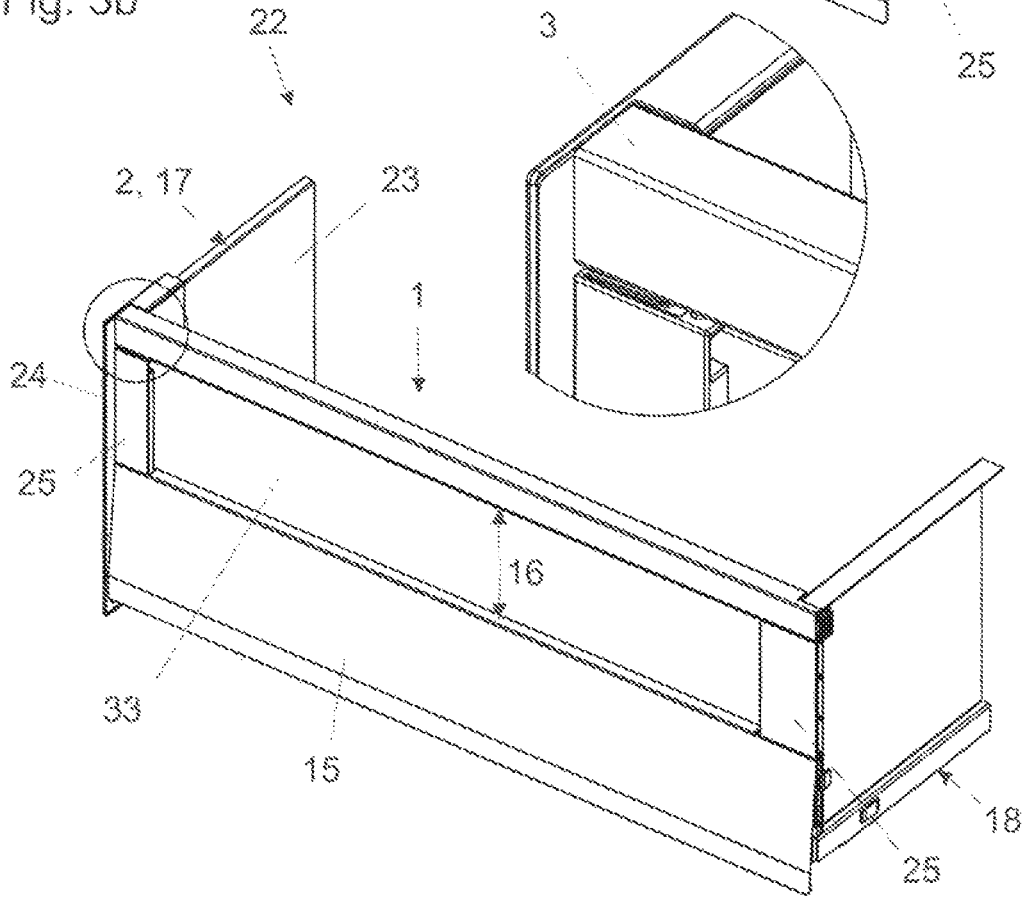

FIGS. 3*a* and 3*b* show a part of a drawer 22 having an arrangement comprising a rail bar 1 and a wall element 2 in the form of a front panel 17 according to a third preferred embodiment.

The front panel 17 includes a decorative element 23, for example of glass, which is held by a holder 24. In the specific case illustrated the drawer 22 can be used as an internal drawer in an article of furniture.

The rail bar 1 is of a substantially quadrangular configuration in cross-section. It is connected with a first end 3 to the front panel 17 and an opposite end to the rear wall 18.

The drawer 22 further has a drawer side wall 15. The rail bar 1 is arranged at a spacing 16 above the drawer side wall 15. A decorative element 33, for example of glass, is arranged between the rail bar 1 and the drawer side wall 15. The decorative element 33 is held at the ends by two holders 25.

By virtue of tolerances, for example manufacturing tolerances or tolerances which can occur by virtue of assembly of the drawer 22, a gap can occur between an end of the rail bar 1 and the corresponding wall element 17 or 18, and that gap can damage the visual appearance. In order to cover that gap, the rail bar 1 includes a length adjustment element 14. In the present case, this length adjustment element 14 is arranged region-wise within the rail bar 1 and projects precisely so far beyond the rail bar 1 as is necessary to cover the gap. A relatively large gap has to be covered in FIG. 3*a*, as the enlarged portion of the region of the end 3 of the rail bar 1 shows. In comparison therewith, in the case shown in FIG. 3*b* there is no gap which would have to be covered. The length adjustment element 14 automatically takes account of those different situations by being moved out of the rail bar 1 as far until it comes to bear against the wall element 2, under the influence of the spring element which is not visible in these Figures.

Figure 4A:
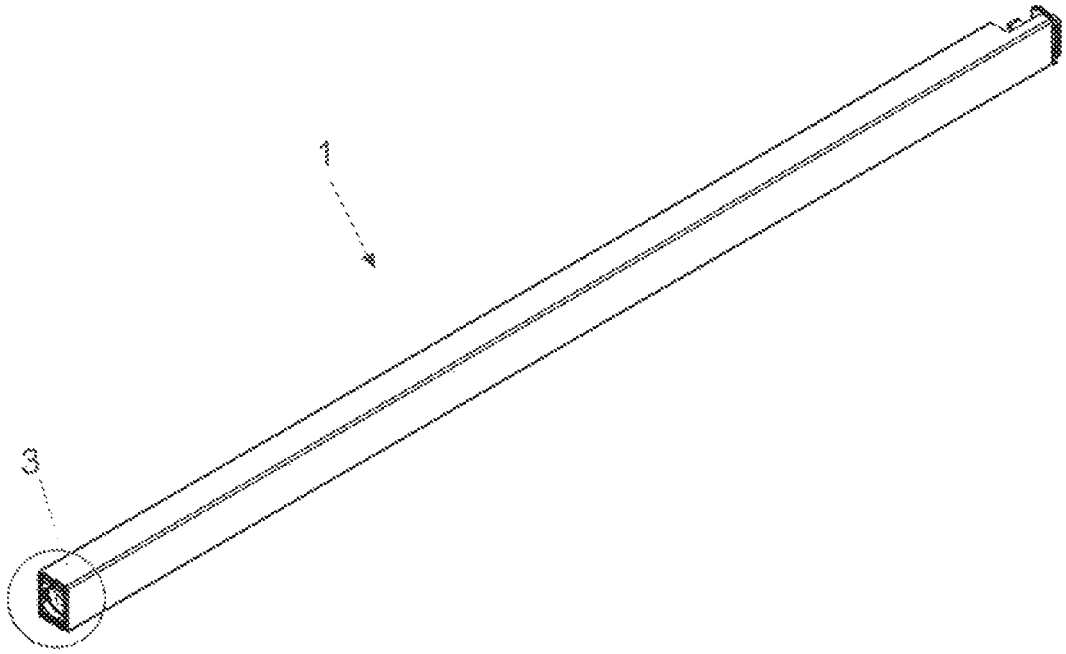
FIG. 4*a* is a diagrammatic perspective view of a rail bar according to a second preferred embodiment.
Figure 4B:
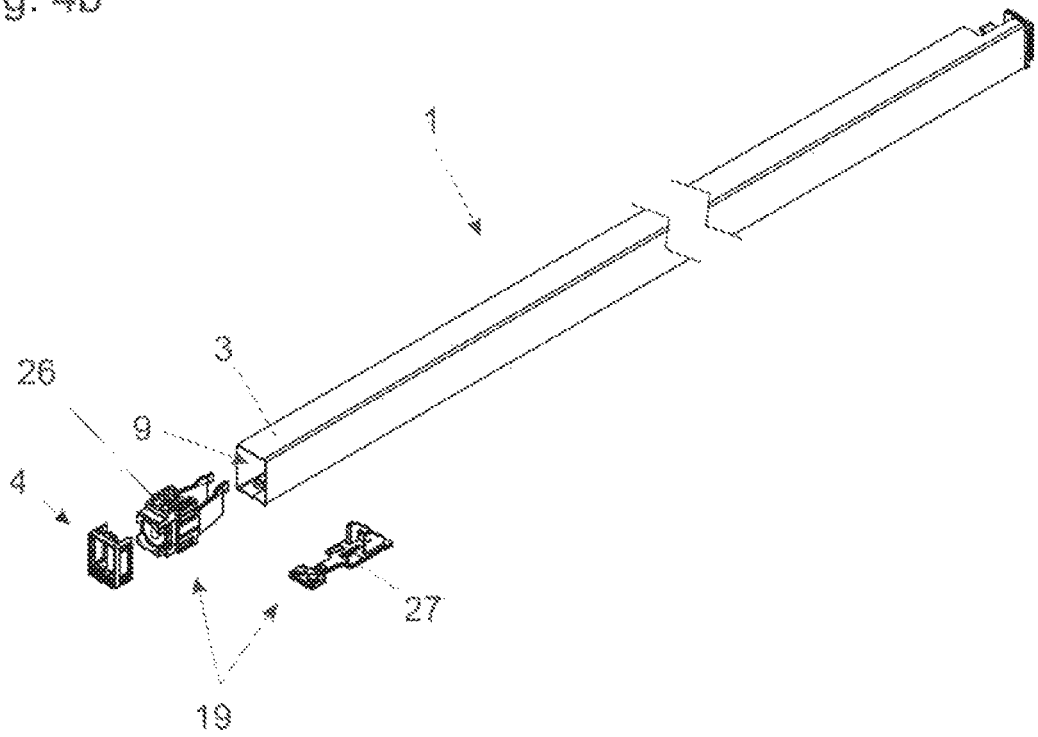
FIG. 4*b* is an exploded view of the rail bar of FIG. 4*a,*

FIG. 4*a* shows a diagrammatic perspective view of a rail bar 1 according to a second preferred embodiment with the end 3 of the rail bar 1 being circled. FIG. 4*b* shows the rail bar 1 of FIG. 4*a* as an exploded view. As can be seen from these views, the rail bar 1 has a cavity 9. The length adjustment element 4 is arranged region-wise in the at least one cavity 9.

Furthermore, a fixing device 19 for a furniture fitment 12 which is separate from the length adjustment element 14 and which is to be mounted to the wall element 2 of the drawer is integrated into the rail bar 1. That fixing device 19 includes a first part 26 and a second part 27.

Figure 5A:
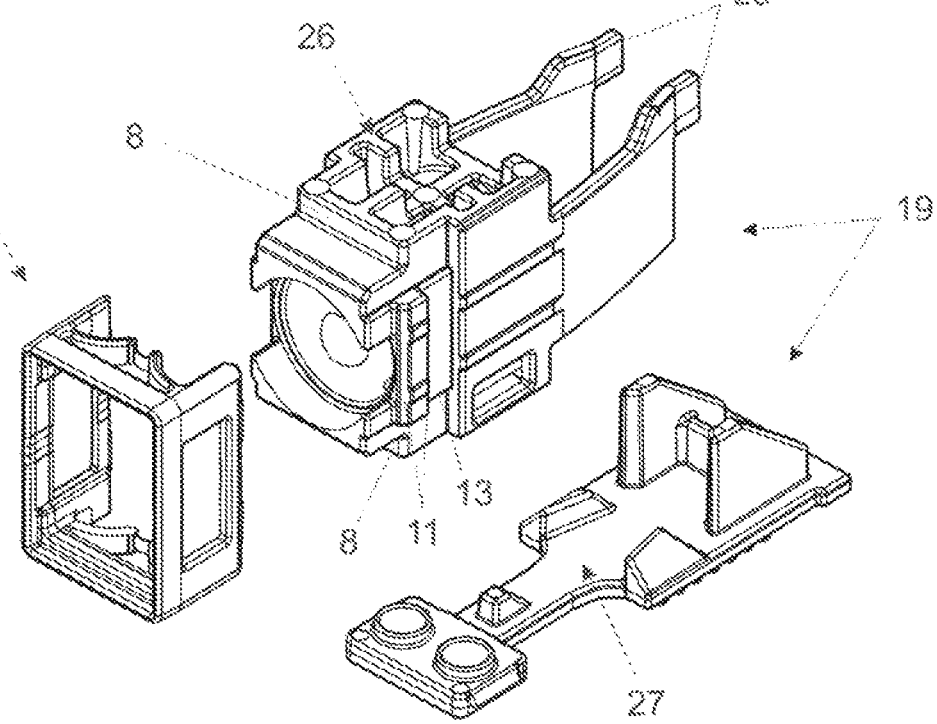
FIG. 5*a* shows three components fitted into the front end of the rail bar in a view on an enlarged scale in comparison with FIG. 4*b,*
Figure 5B:
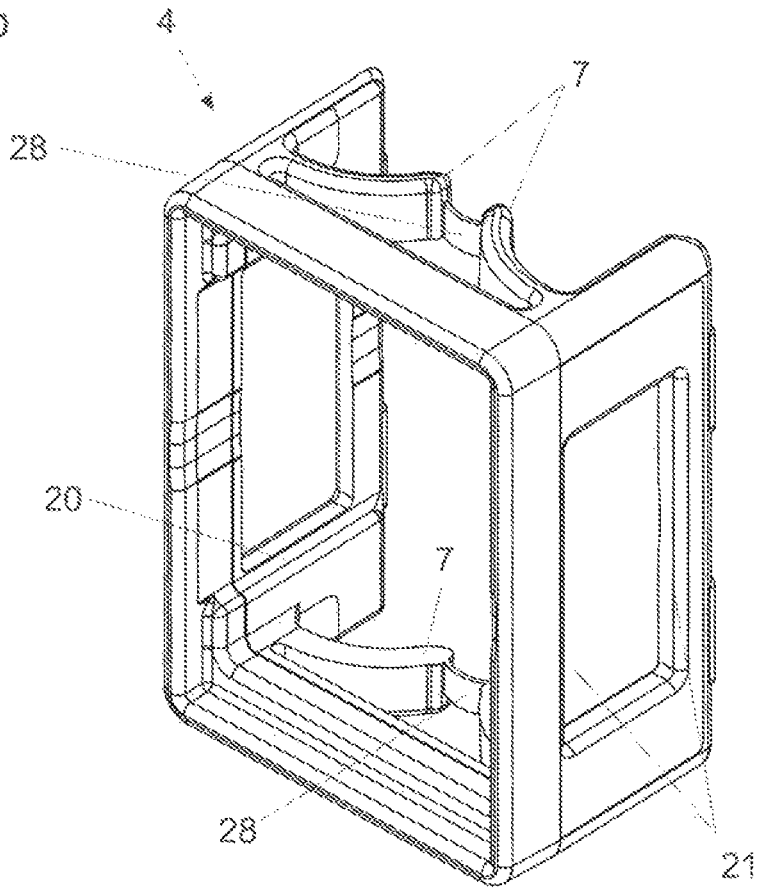
FIG. 5*b* is a view of the length adjustment element on a scale further increased in relation to FIG. 5*a,*

The length adjustment element 4 is shown on an enlarged scale in FIGS. 5*a* and 5*b*. FIG. 5*a* further shows the two parts 26 and 27 of the fixing device 19.

As can be seen from these Figures, the length adjustment element 4 includes overall four spring elements 7 in the form of elastic spring tabs, wherein two of those spring tabs are respectively connected together by way of a connecting bar 28. These connecting bars 28 prevent a hooking engagement upon assembly. The spring elements 7 are formed on the length adjustment element 4.

The part 26 of the fixing device 19 is fixed to the part 27 in the assembled state, wherein the part 27 is in turn fixed to an inside wall of the rail bar 1. Provided on the part 26 are two support contours at which the spring elements 7 are supported. These support contours therefore form stationary parts 8 of the rail bar 1 against which the spring elements 7 are supported. In the present case the stationary parts 8 are therefore formed on an insert disposed in the interior of the rail bar 1.

There is also a guide 13, 20 for guiding the length adjustment element 4 upon a movement relative to the rail bar 1. In the specifically illustrated case, the guide is formed by two mutually oppositely disposed guide bars 20 which co-operate with corresponding contours 13. The guide bars 20 are formed on the length adjustment element 4, whereas the corresponding contours 13 are provided on the fixing device 19.

In addition, there are abutments 11, 21 for limiting the movement of the length adjustment element 4 relative to the rail bar 1. In the specifically illustrated case, on the one hand, the length adjustment element 4 has abutments 21 which co-operate with abutments 11 provided on the fixing device 19.

It is also to be noted that the part 26 of the fixing device 19 includes two spring elements 29 which serve for fixing a furniture fitment 12 which is separate from the length adjustment element 4 and which is to be mounted to the wall element 2 of the drawer.

Figure 6A:
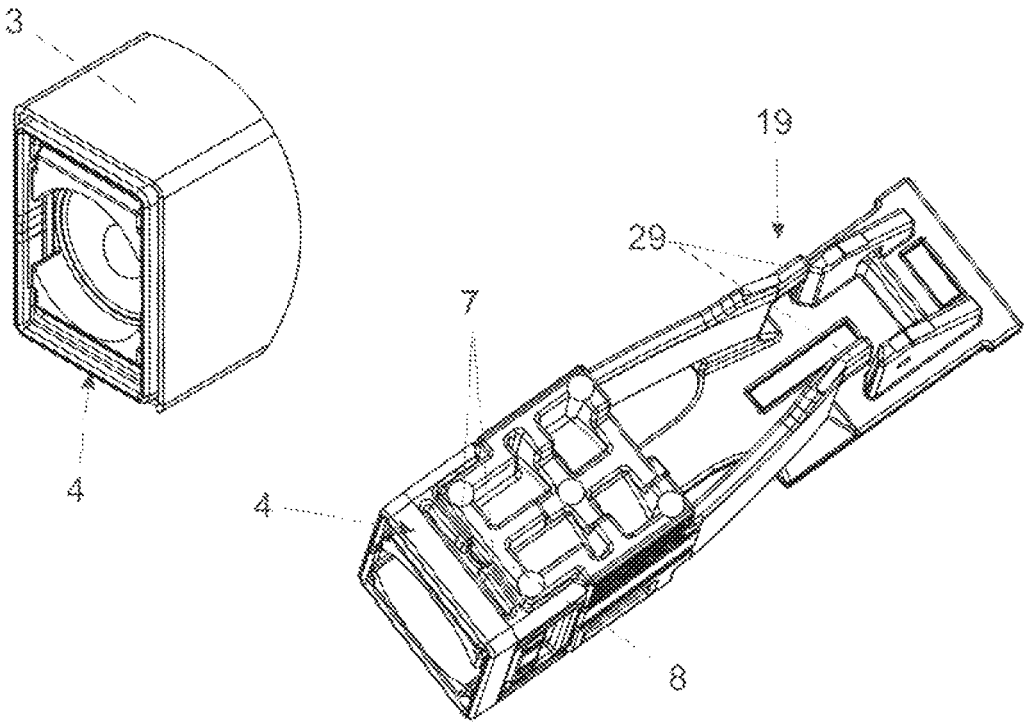
FIGS. 6*a* and *b* show three components fitted into the front end of the rail bar as illustrated in FIG. 5*a* in the assembled state, more specifically in two different positions of the length adjustment element.
Figure 6B:
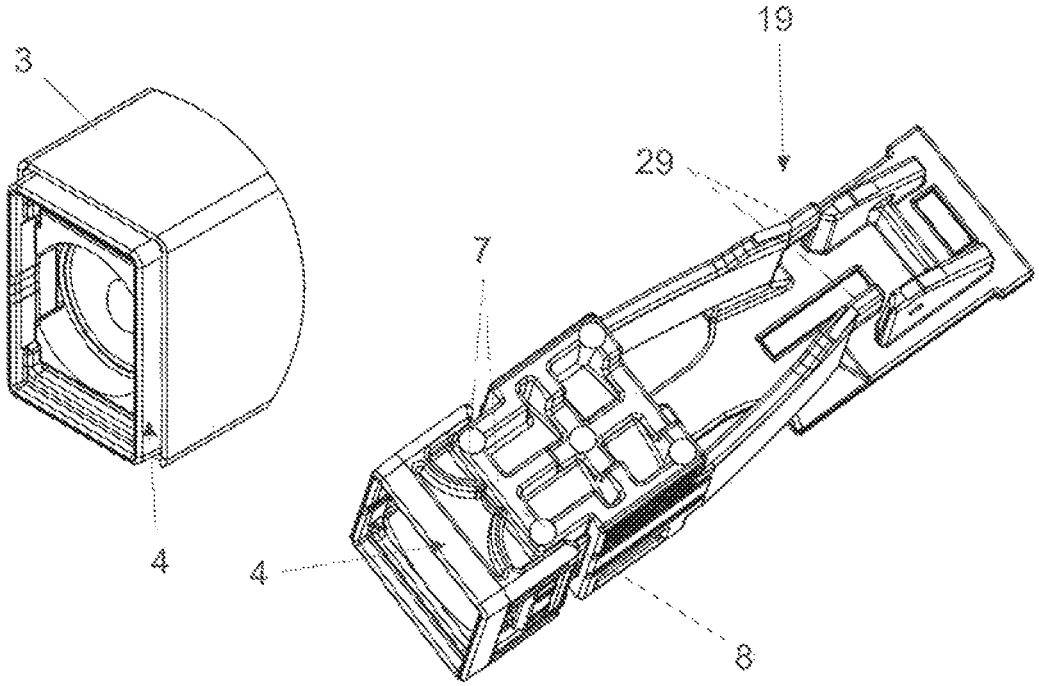

FIGS. 6*a* and 6*b* show the three components 4, 26 and 27 inserted in the end 3 of the rail bar 1 in the assembled state, more specifically in two different positions of the length adjustment element 4. In the position shown in FIG. 6*a*, the length adjustment element 4 projects to a lesser extent out of the rail bar 3 than in the position shown in FIG. 6*b*. In these Figures, for orientation purposes, the respective end 3 of the rail bar 1 is shown on an enlarged scale (see the circled region of the rail bar in FIG. 4*a*).

As can be seen, the length adjustment element 4 bears by way of the spring elements 7 against the stationary parts 8 of the rail bar 1 and as a result is moved out of the rail bar 1 and, more specifically, to such an extent that the length adjustment element 4 comes to bear against the wall element 2 or until the movement of the length adjustment element 4 is limited by the abutments 11 and 21 described with reference to FIGS. 5*a* and 5*b*.

Figure 7A:
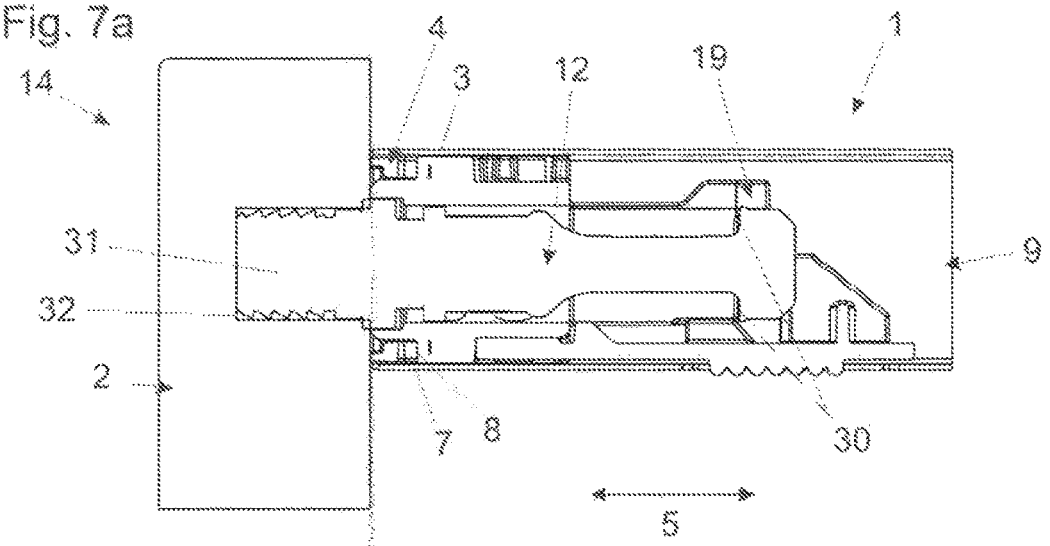
FIGS. 7*a-c* show a diagrammatic cross-sectional view from the side of an arrangement comprising a rail bar and a wall element according to a fourth preferred embodiment, wherein the rail bar assumes three different positions relative to the wall element in the connected state.
Figure 7B:
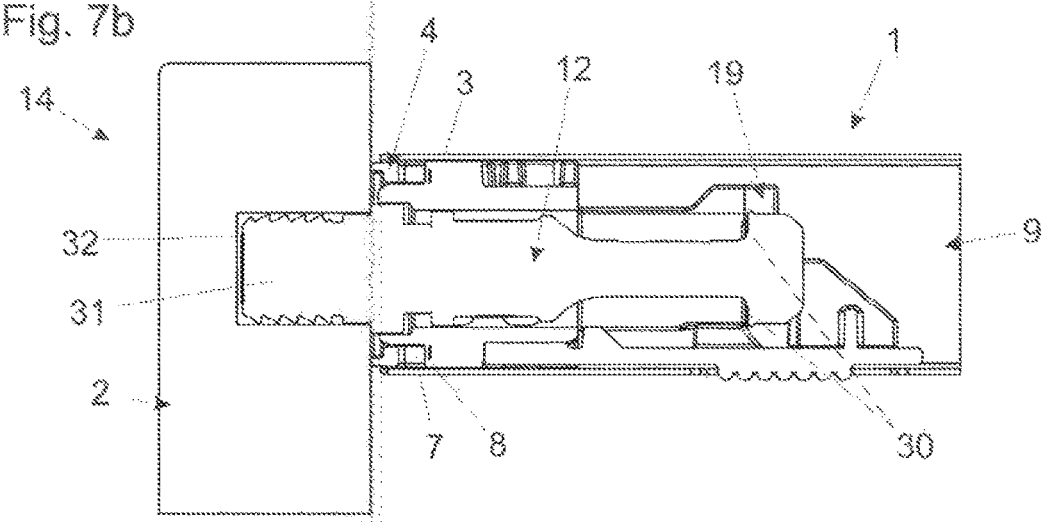
Figure 7C:
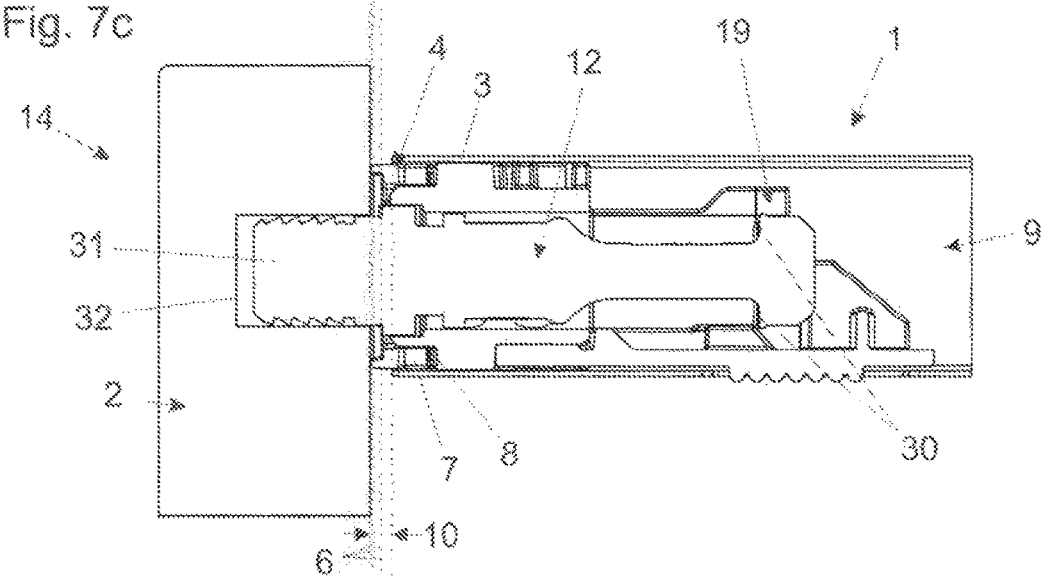

FIGS. 7*a*, 7*b* and 7*c* show an arrangement 14 comprising a rail bar 1 and a wall element 2 according to a fourth preferred embodiment as a diagrammatic cross-sectional view from the side, wherein the rail bar 1 assumes three different positions relative to the wall element 2. These positions arise by virtue of the fact that the furniture fitment 12 with the dowel 31 is pressed to different depths into the recess 32 in the wall element 2 upon assembly, and that at the same time the furniture fitment 12 is fixed, preferably releasably, by the fixing device 19 at a predetermined position relative to the rail bar 1. That results in different gaps 6. The invention makes it possible to automatically cover these gaps 6.

The position shown in FIG. 7*a* substantially corresponds to the minimum position of the length adjustment element 4 in which the length adjustment element 4 prolongs the rail bar 1 to the minimum extent or not at all, whereas the position in FIG. 7*c* substantially corresponds to the maximum position of the length adjustment element 4 in which the length adjustment element 4 prolongs the rail bar 1 to the maximum extent. The spacing 10 between the maximum position and the minimum position is between 1 mm and 3 mm, preferably between 1.5 mm and 2 mm.

The furniture fitment 12 is fixed by the fixing device 19 by way of the spring elements 29 mentioned previously in relation to FIG. 5*a*. They co-operate with a latching contour 30 provided on the furniture fitment 12.

The invention claimed is:

1. A rail bar for a drawer, comprising:

an end to be connected to a wall element;

at least one length adjustment element movable in a longitudinal direction of the rail bar relative to the rail bar in order to cover a gap occurring between the end of the rail bar and the wall element in a connected state of the rail bar to the wall element; and at least one spring element which is supported on at least one stationary part of the rail bar and exerts a biasing force which pushes the at least one length adjustment element in a direction of a maximum position in which the at least one length adjustment element prolongs the rail bar to a maximum extent, wherein the at least one length adjustment element is movable against the biasing force of the at least one spring element to a minimum position in which the at least one length adjustment element does not project from the end of the rail bar in the longitudinal direction.

2. The rail bar according to claim 1, wherein the at least one length adjustment element projects region-wise beyond the end of the rail bar in the longitudinal direction in positions in which the at least one length adjustment element prolongs the rail bar.

3. The rail bar according to claim 1, wherein the rail bar has at least one cavity and the at least one length adjustment element is arranged region-wise in the at least one cavity.

4. The rail bar according to claim 1, wherein the at least one spring element is formed on the at least one length adjustment element.

5. The rail bar according to claim 1, wherein the at least one stationary part is in the form of an insert arranged in an interior of the rail bar.

6. The rail bar according to claim 1, wherein a spacing between the maximum position and the minimum position is between 1 mm and 3 mm.

7. The rail bar according to claim 6, wherein the spacing between the maximum position and the minimum position is between 1.5 mm and 2 mm.

8. The rail bar according to claim 1, further comprising at least one abutment for limiting the movement of the at least one length adjustment element relative to the rail bar.

9. The rail bar according to claim 1, wherein the rail bar has a fixing device for a furniture fitment which is to be mounted to the wall element of the drawer.

10. The rail bar according to claim 9, wherein the fixing device is configured to fix a furniture fitment at a predetermined position relative to the rail bar.

11. The rail bar according to claim 10, wherein the fixing device is configured to releasably fix a furniture fitment at the predetermined position relative to the rail bar.

12. The rail bar according to claim 1, further comprising at least one guide for guiding the at least one length adjustment element upon a movement relative to the rail bar.

13. The rail bar according to claim 1, wherein the rail bar is of a substantially quadrangular configuration in cross-section.

14. An arrangement comprising:

the rail bar according to claim 1; and at least one wall element, wherein the end of the rail bar is connected to the at least one wall element and defines a gap between the end of the rail bar and the at least one wall element, the gap being covered by the at least one length adjustment element.

15. The arrangement according to claim 14, further comprising a furniture fitment which is separate from the at least one length adjustment element and which is fixed to the at least one wall element and to the rail bar.

16. The arrangement according to claim 15, wherein the furniture fitment is fixed to the at least one wall element and to the rail bar at a predetermined position relative to the rail bar.

17. The arrangement according to claim 14, further comprising a drawer side wall, wherein the rail bar is arranged above the drawer side wall.

18. The arrangement according to claim 17, wherein the rail bar is arranged at a spacing above the drawer side wall.

19. A drawer including the arrangement according to claim 14.

20. The arrangement according to claim 14, wherein the at least one wall element includes a front panel or a rear wall of a drawer.

21. The rail bar according to claim 1, wherein the end of the rail bar is configured to be connected to a front panel or a rear wall of a drawer.

* * * * *